US009647402B2

(12) United States Patent
Lee et al.

(10) Patent No.: US 9,647,402 B2
(45) Date of Patent: May 9, 2017

(54) POWER CONNECTOR PRODUCTS WITH IMPROVED SCHUKO GROUNDING SOCKET

(71) Applicant: Europlugs LLC, Chandler, AZ (US)

(72) Inventors: Rock Lee, Chandler, AZ (US); Harrison Lee, Chandler, AZ (US); Ying Huang, Fujian Province (CN)

(73) Assignee: EUROPLUGS LLC, Chandler, AZ (US)

( * ) Notice: Subject to any disclaimer, the term of this patent is extended or adjusted under 35 U.S.C. 154(b) by 0 days.

(21) Appl. No.: 15/093,807

(22) Filed: Apr. 8, 2016

(65) Prior Publication Data

US 2016/0301167 A1 Oct. 13, 2016

Related U.S. Application Data

(63) Continuation-in-part of application No. 14/683,248, filed on Apr. 10, 2015, now Pat. No. 9,484,659.

(51) Int. Cl.

| | |
|---|---|
| ***H01R 13/60*** | (2006.01) |
| ***H01R 24/78*** | (2011.01) |
| ***H01R 13/652*** | (2006.01) |
| ***H01R 13/453*** | (2006.01) |
| *H01R 13/11* | (2006.01) |
| *H01R 24/22* | (2011.01) |

(52) U.S. Cl.

CPC ..... *H01R 24/78* (2013.01); *H01R 13/4534* (2013.01); *H01R 13/652* (2013.01); *H01R 13/11* (2013.01); *H01R 24/22* (2013.01)

(58) Field of Classification Search

CPC .. H01R 31/02; H01R 13/652; H01R 13/4534; H01R 13/4536; H01R 13/4532; H01R 13/6275; H01R 25/006; H02G 3/18; H02G 3/14

USPC ..... 439/105, 106, 135–145, 149, 345, 535; 174/53, 66, 67

See application file for complete search history.

(56) References Cited

U.S. PATENT DOCUMENTS

| | | | | |
|---|---|---|---|---|
| 3,736,547 A * | 5/1973 | Koenig | H01R 13/453 | 439/137 |
| 5,007,848 A * | 4/1991 | Lee | H01R 27/02 | 439/101 |
| 5,919,060 A * | 7/1999 | Lee | H01R 31/06 | 439/177 |

(Continued)

FOREIGN PATENT DOCUMENTS

| | | |
|---|---|---|
| GB | 793000 | 4/1958 |
| GB | 2199996 B | 7/1988 |

*Primary Examiner* — Thanh Tam Le

(74) *Attorney, Agent, or Firm* — Jackson IPG PLLC; Demian K. Jackson

(57) ABSTRACT

The present invention relates to a power connector provided with an improved Schuko grounding socket architecture. The Schuko grounding socket architecture includes a Schuko access portion, which includes Schuko contacts located beyond the top face panel. The Schuko contacts are configured in the form of a flat metallic surface substantially parallel to the top face panel to provide a sufficient surface area for physical contact with the flat grounding contact of the Schuko plug, thereby ensuring a good ground contact with the plug. Preferably, the Schuko contacts are in turn bent over to gain additional structural strength.

15 Claims, 14 Drawing Sheets

(56) References Cited

U.S. PATENT DOCUMENTS

| | | | | |
|---|---|---|---|---|
| 6,010,347 | A * | 1/2000 | Lee | H01R 4/36 439/107 |
| 6,281,438 | B1 * | 8/2001 | Desilets | H01R 13/652 174/53 |
| 7,537,468 | B1 * | 5/2009 | Huang | H01R 13/4536 439/135 |
| 7,736,174 | B2 * | 6/2010 | Bhosale | F21V 33/00 365/95 |
| 7,790,982 | B2 * | 9/2010 | Weeks | H01R 13/4534 174/50 |
| 8,313,350 | B2 * | 11/2012 | Lee | H01R 24/28 439/172 |
| 8,795,006 | B2 * | 8/2014 | Hoffman | H01R 4/363 439/811 |
| 9,059,530 | B2 * | 6/2015 | Byrne | H01R 13/4534 |

* cited by examiner

POWER CONNECTOR PRODUCTS WITH IMPROVED SCHUKO GROUNDING SOCKET

CROSS-REFERENCE TO RELATED APPLICATION

This application is a continuation-in-part of U.S. application Ser. No. 14/683,248 filed Apr. 10, 2015, the entirety of which is incorporated herein by reference.

BACKGROUND OF THE INVENTION

Field of the Invention

The present invention relates to a power connector for receiving an electric plug, and more particularly to a power connector provided with an improved Schuko grounding socket architecture.

Description of Related Art

Each country has its own type of electric plugs and socket-outlets, and the plugs from one country are often physically incompatible with the sockets from the other countries. For instance, there are six different types of socket outlets used in Europe, each differing mainly in the grounding system. To address the difference in sockets and plugs, a tourist who travels around different countries may need a travel plug adapter to fit the plug of his/her electrical appliance into a domestic socket.

A travel plug adapter is usually provided with a universal socket layout for receiving the plug types in common use, such as a Schuko plug. The Schuko plug-socket system, or the CEE 7/4 system as defined by the European Commission for Conformity Testing of Electrical Equipment (CEE), is the most popular system in Europe. As estimated, about 250 million people within the European Union and another 225 million elsewhere in Europe are using Schuko-compatible plugs and sockets. This means that approximately 49% of people in the European Union rely on the Schuko system. According to the system, a Schuko plug has two 4.8 mm round pins spaced 19 mm apart for the line and neutral contacts, plus two flat contact areas on the top and bottom side of the plug for protective earth.

In order to construct a universal socket architecture that can receive as many as possible types of plugs, efforts have been made in the past twenty five years. FIG. 13 shows a conventional universal socket, which can take most types of electric plugs used in Europe, but its common socket frame 50' does not have enough contact area to attach properly to the flat earth contacts of a Schuko plug, causing a poor ground connection with the Schuko plug.

Thus, there is still a need for a power connector device provided with a robust universal socket architecture that can take the plug types in common use around the world, while being adapted to assure a good ground connection with a Schuko plug.

SUMMARY OF THE INVENTION

In one aspect provided herein is an improved power connector for engagement with a Schuko plug having two male power contacts and a flat grounding contact. The power connector is equipped with a common grounding frame having a Schuko access portion adapted to either engage the flat grounding contact of the Schuko plug or take the pin-shaped male grounding contact of a plug of another type. The power connector comprises:

a dielectric housing, comprising a top face panel, wherein the top face panel is formed with two power receptacles, through which the male power contacts may be inserted, and a grounding receptacle;

two electrically conductive power output frames mounted spaced apart in the housing, each having an output contact portion facing towards the top face panel and adapted for receiving the respective male contact of the electric plug through the respective power receptacle along an insertion direction, and an input portion remote from the top face panel; and an electrically conductive common grounding frame, comprising a common grounding base remote from the top face panel, and a Schuko access portion connected to the common grounding base, the Schuko access portion facing towards the top face panel and having two resilient gripping fingers, wherein the resilient gripping fingers extend upwardly beyond the top face panel through the grounding receptacle and bent outwardly in opposite directions to constitute flat Schuko contacts adapted to engage the flat grounding contact of the Schuko plug.

According to the invention, the Schuko access portion includes Schuko contacts located beyond the top face panel, and the Schuko contacts are configured in the form of a flat metallic surface substantially parallel to the top face panel to provide a sufficient surface area for physical contact with the flat grounding contact of the Schuko plug, thereby ensuring a good ground contact with the plug. Preferably, the Schuko contacts are in turn bent over to gain additional structural strength.

In a preferred aspect provided herein, the common grounding frame is fabricated as a single-piece member and arranged to extend along a substantially full depth of the dielectric housing, so as to firmly abut against the inner wall of the dielectric housing, thereby resisting the downward force exerted by insertion of a three-pin plug. The Schuko contacts are arranged to lie on the shoulder portions surrounding the Schuko grounding receptacle, thereby further countering the downward force.

In another preferred aspect provided herein, the common grounding frame is fabricated as a two-piece member, in which the Schuko access portion is sleeved within the common grounding base, so that the Schuko access portion is allowed to move back and forth relative to the common grounding base along the insertion direction. By virtue of this arrangement, the Schuko contacts can be located beyond the top face panel for contact with a Schuko plug, and can also be retracted into the housing to be protected from unwanted engagement and external damage.

The power connector disclosed herein is intended to serve as a common architecture applicable to various forms of adapters and socket-outlets.

DETAILED DESCRIPTION OF THE PREFERRED EMBODIMENTS

The technical contents and characteristics of the present invention will be apparent with reference to the detailed description of preferred embodiments accompanied with related drawings as follows.

Figure 1A:
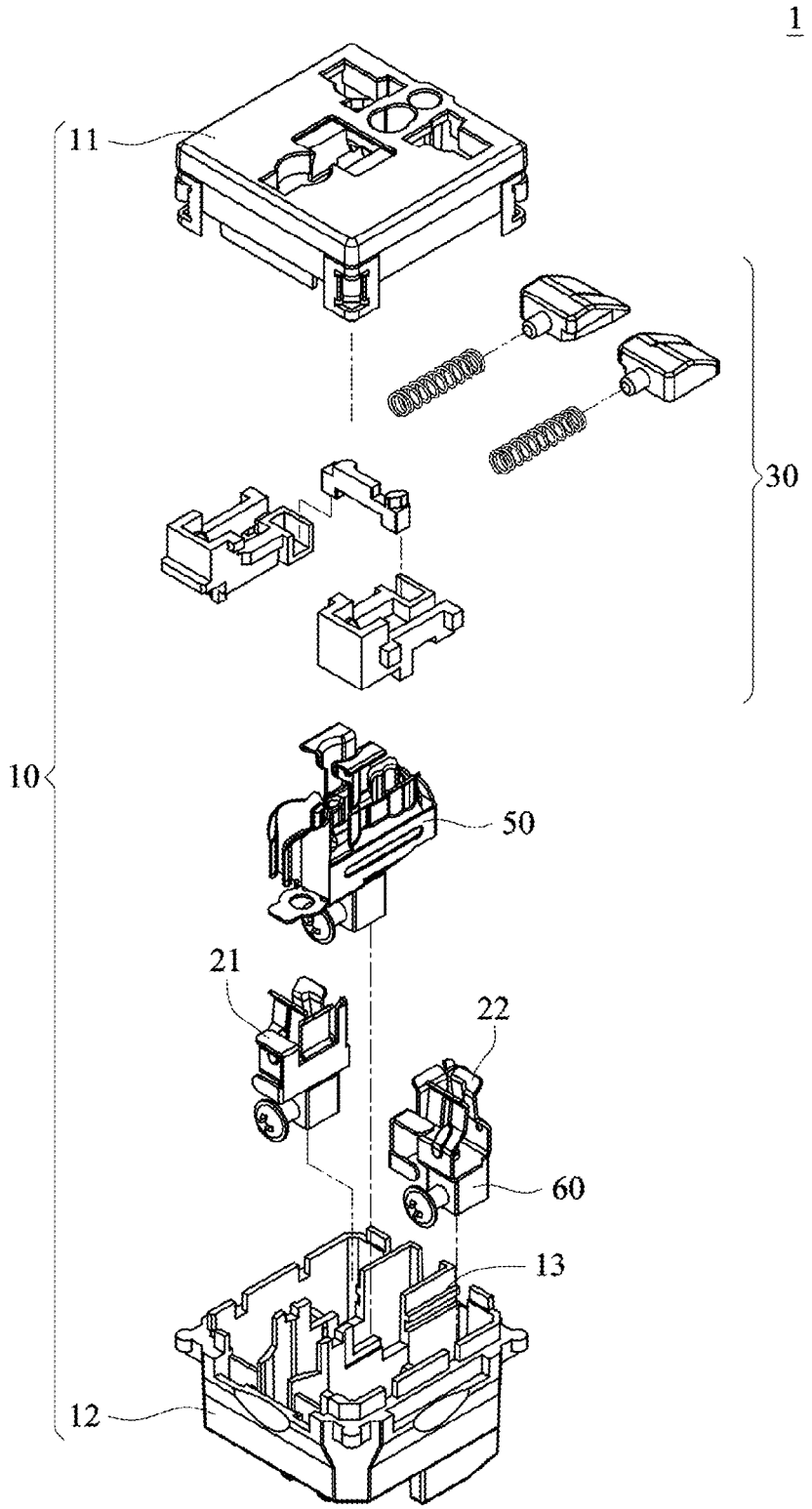
FIG. 1A is an exploded schematic view of a power connector according to an embodiment of the invention.
Figure 1B:
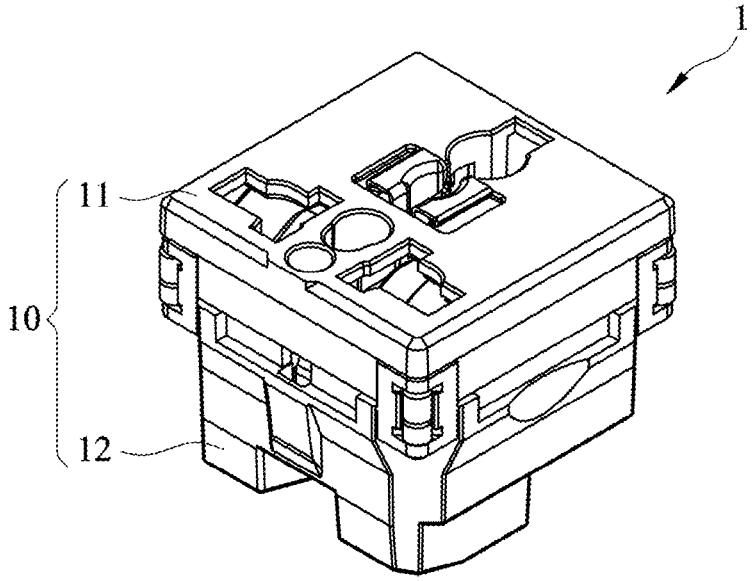
FIG. 1B is a perspective schematic view of a power connector according to an embodiment of the invention.

A power connector 1 according to a preferred embodiment of the invention is shown in FIGS. 1A and 1B, which comprises a dielectric housing 10, two power output frames 21, 22 mounted in the housing 10, and a common grounding frame 50 mounted in the housing 10.

The dielectric housing 10 comprises a top face panel 11, a bottom face panel 12 and a surrounding side wall to define an interior cavity 13. Desirably, the dielectric housing 10 includes two partition walls arranged in parallel to divide the interior cavity 13 into a middle chamber disposed between the partition walls and two lateral chambers disposed at two opposite sides of the middle chamber. The dielectric housing 10 is made of any dielectric material known in the art, such as plastics and phenolic resins. In a preferred embodiment, the top face panel 11 and the rest of the housing 10 are separately injection molded and then assembled together to form a single module.

Figure 2:
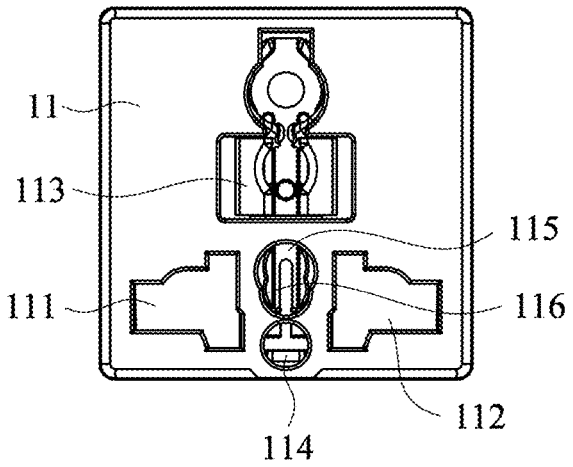
FIG. 2 shows the top face panel of a power connector according to an embodiment of the invention.

The top face panel 11 is formed with a plurality of receptacles to constitute a universal socket layout for receiving the plug types in common use around the world, which include but are not limited to European, British, US, North African and Australian plugs. As shown in FIG. 2, the universal socket layout includes two power receptacles, i.e., the neutral (N) and live (L) receptacles 111, 112, adapted to receive the neutral and live contacts of an electric plug. One or more grounding receptacles are formed on the top face panel 11 to receive the grounding contact of the plug, which may include and are not limited to a Schuko grounding receptacle 113, a Swiss grounding receptacle 114 and an Italian grounding receptacle 115 merged with a Brazil grounding receptacle 116. It should be noted that the Swiss grounding receptacle 114 disclosed herein is located at very outside of the universal socket layout, in contrast to its conventional location right next to the Italian grounding receptacle 115. The new location will force a Swiss plug to be inserted into the power connector 1 in a different orientation and thus overcome the N-L reversal problem as in the traditional universal socket layout, a problem having been lasting for the past twenty five years.

Figure 3:
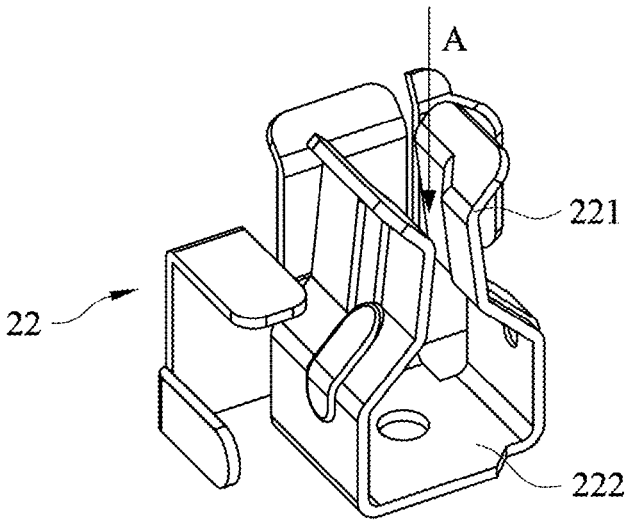
FIG. 3 shows the power output frame of a power connector according to an embodiment of the invention.

The power output frames 21, 22 are secured inside the housing 10 in a manner spaced apart from each other, and preferably held within the lateral chambers of the interior cavity 13, respectively. Each of them is preferably a single-piece member made of material with high electrical conductivity, preferably made of one or more conductive metal elements or metal alloys, such as brass or phosphor copper. The power output frames 21, 22 can be fabricated by any process known in the art, including metal stamping and punch pressing. As shown in FIGS. 1A and 3, the power output frames 21, 22 each includes an output contact portion 211, 221 facing towards the top face panel 11 and an input portion 212, 222 remote from the top face panel 11, preferably facing towards the bottom face panel 12. The output contact portion 211, 221 each includes a resilient member for holding the male power contacts of a plug, which is preferably configured in the form of a resilient metal clip having a gripping part conforming in shape to the shapes of the prong-, blade- and pin-shaped male contacts of the plugs used in various countries. The output contact portion 211, 221 are registered with the power receptacles 111, 112, so that they are adapted for receiving the power contacts of the electric plug through the power receptacles 111, 112 along an insertion direction indicated by the arrow A, thereby establishing electrical connection between the power output frames 21, 22 and the electric plug.

Desirably, the common grounding frame 50 is secured within the middle chamber of the interior cavity 13. The common grounding frame 50 is made of material with high electrical conductivity, preferably made of one or more conductive metals or metal alloys, such as brass or phosphor copper. The common grounding frame 50 can be fabricated by any process known in the art, such as metal stamping and punch pressing.

Figure 4A:
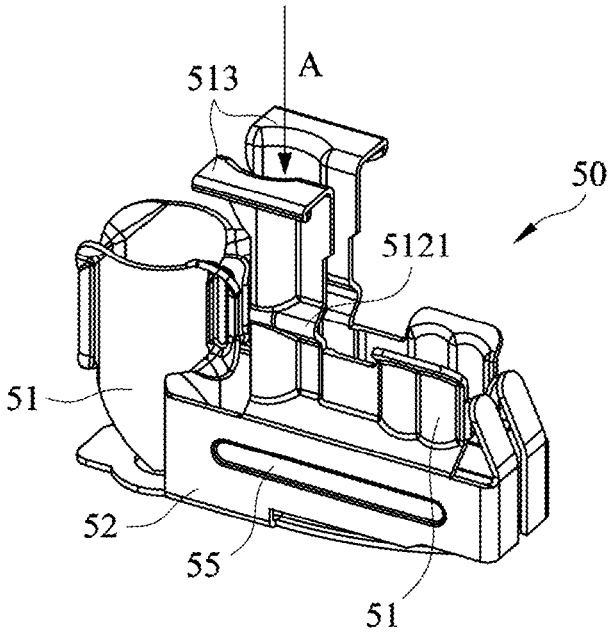
FIGS. 4A-4B are schematic views of the common grounding frame according to the first embodiment of the invention.
Figure 4B:
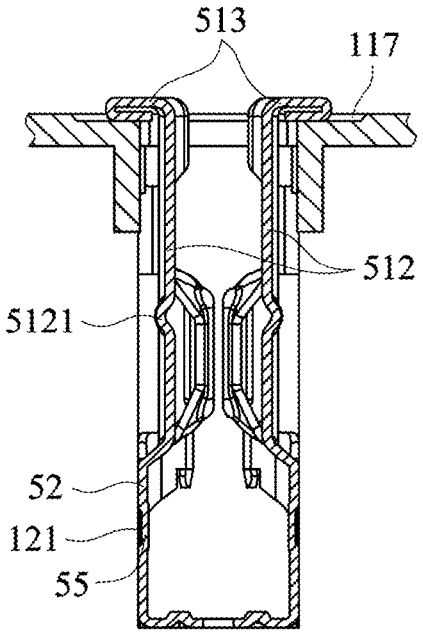
Figure 12A:
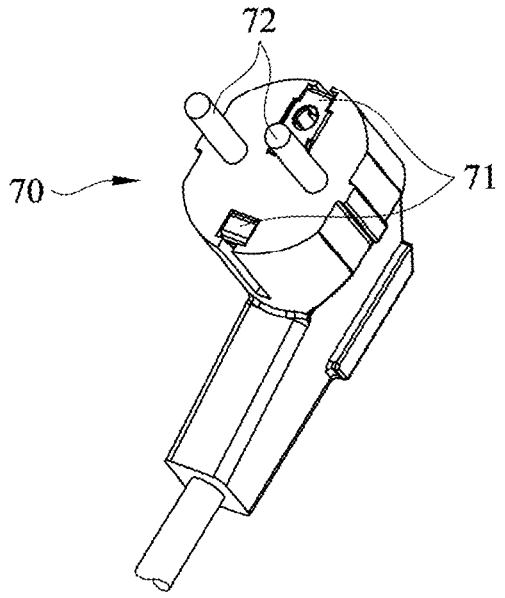
FIGS. 12A-12B are schematic diagrams showing a Schuko plug to be brought into engagement with the power connector disclosed herein.
Figure 12B:
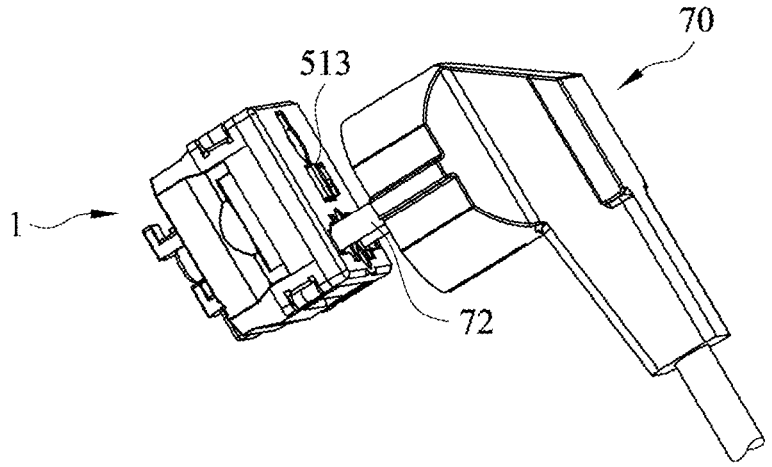
Figure 13:
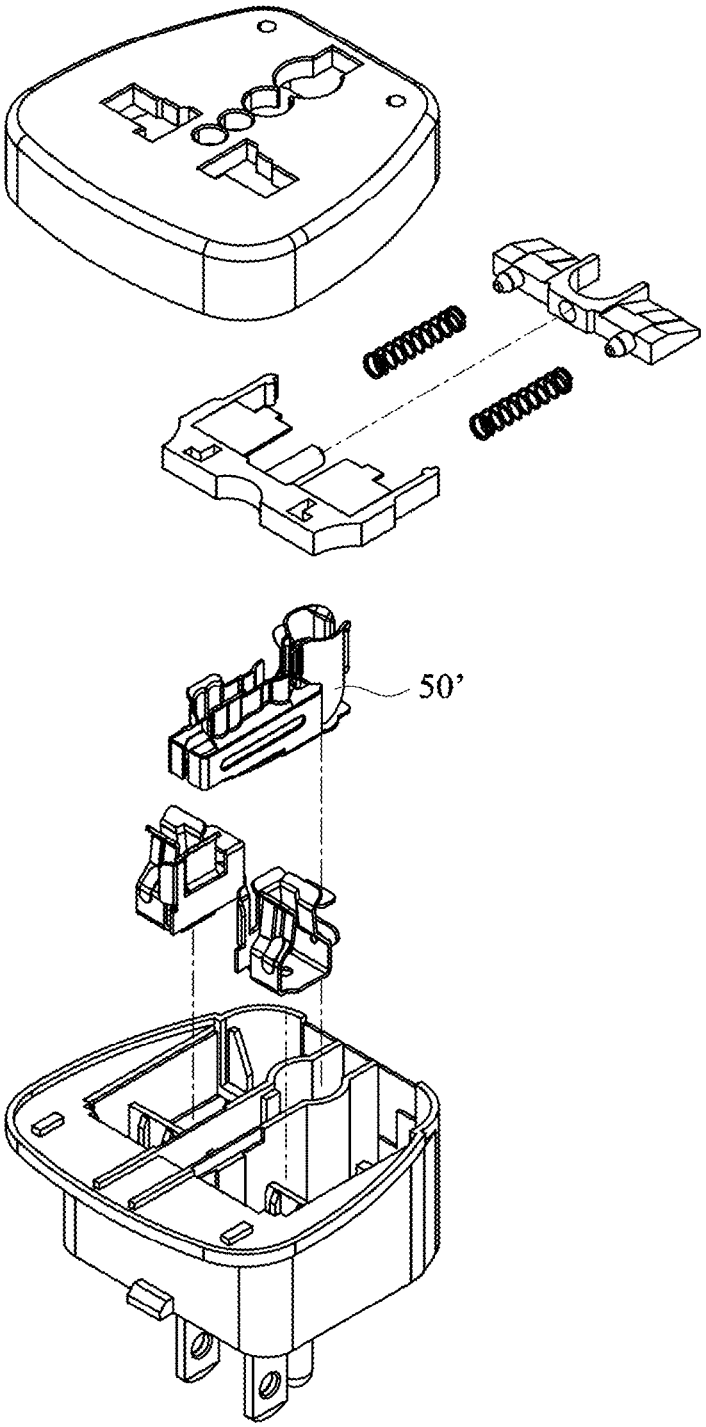
FIG. 13 PRIOR ART
FIG. 13 is an exploded schematic view of a power connector known in the art.

As shown in FIGS. 1 and 4A, 4B, the common grounding frame 50 includes one or more access portions 51 facing towards the top face panel 11 and a common grounding base 52 remote from the top face panel 11, preferably facing towards the bottom face panel 12. It should be noted that the common grounding frame 50 can be configured to include any combination of access portions 51 to receive plugs of desired specifications. The access portions 51 each includes a resilient member for receiving and holding the grounding contact of a plug, which is preferably configured in the form of a resilient metal clip having a gripping part conforming in shape to the plug contact. The access portions 51 are registered with the grounding receptacles 113-116 formed on the top face panel 11, so that they are adapted for receiving the grounding contact of the electric plug through the grounding receptacles 113-116 along the insertion direction A, thereby establishing electrical connection between the common grounding frame 50 and the electric plug. Among them, a Schuko access portion 511 is adapted to engage the flat grounding contact of a Schuko plug and also take the pin-shaped male grounding contact of a US, Danish or Israeli plug. The term "Schuko" as used herein refers to a system of AC power plugs and sockets that is defined as CEE 7/3 for the sockets and CEE 7/4 for the plugs by the European Commission for Conformity Testing of Electrical Equipment (CEE). As shown in FIG. 12A, a Schuko plug 70 features two round power pins 72 of 4.8 mm diameter (19 mm long, centers 19 mm apart) for the live and neutral contacts, plus two flat contact areas 71 on the top and bottom side of the plug 70 for protective earth. The distance between either of the two earth contacts 71 and the middle of the imaginary line connecting the centers of the two power pins 72 is 16 mm. The gripping part of the Schuko access portion 511, preferably in the form of two resilient gripping fingers 512 for holding the male grounding contact of a US, Danish or Israeli plug, extends upwardly beyond the top face panel 11 through the Schuko grounding receptacle 113 and bent outwardly in opposite directions, so as to constitute flat Schuko contacts 513 substantially parallel to the top face panel 11. The Schuko contacts 513 are in turn bent over to gain additional structural strength. As shown in FIG. 12B, the Schuko contacts 513 are adapted for physical contact with the flat grounding contact 71 of the Schuko plug 70, thereby ensuring a good ground contact with the plug 70.

According to the first embodiment shown in FIG. 4A, the common grounding frame 50 is fabricated as a single-piece member. The Schuko contacts 513 are arranged to lie on shoulder portions 117 surrounding the Schuko grounding receptacle 113 and adapted for engagement with the grounding contact of a CEE 7/4 Schuko plug. The shoulder portions 117 may be cut away a depth for anchorage of the Schuko contact 513. More preferably, the Schuko contacts 513 are built in a manner slightly protruding beyond the top face panel 11, such as 1-15 mm higher than the outer surface of the top face panel 11, so as to ensure good ground contact with the plug.

The Schuko access portion 511 is formed with a curved portion 5121 in the middle of the gripping part 512, thereby gaining sufficient resilience to accept both of the 4.8 mm US ground pin and the 6.0 mm Denmark ground pin and then restore back to its original location and shape required by the Schuko grounding.

Figure 5A:
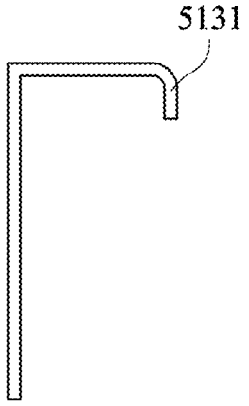
FIGS. 5A-5D are schematic diagrams showing the preferred forms of the Schuko contacts according to the first embodiment of the invention.
Figure 5B:
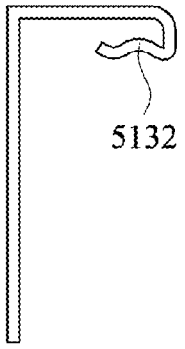
Figure 5C:
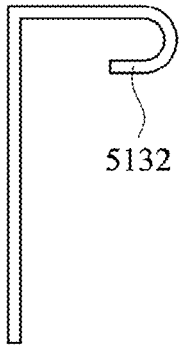
Figure 5D:
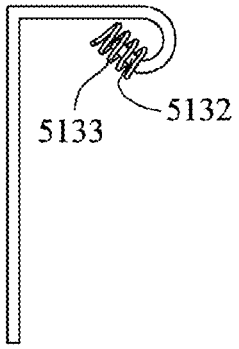

In the first embodiment disclosed herein, additional modifications may be made to the common grounding frame 50, in order to address the problem that the Schuko access portion 511 or even the entire common grounding frame 50 might get permanently pushed down into the interior cavity 13 or get deformed irreversibly after repeatedly receiving US, Denmark and Israeli plugs. First, the common grounding frame 50 is arranged to extend along a substantially full depth of the dielectric housing 10 from the top face panel 11 to the bottom face panel 12, so as to firmly abut against the inner wall of the dielectric housing 10. Second, the Schuko access portion 511 is made from metallic material having a thickness of 1-10 mm, so that it is robust enough to maintain the shape and location thereof. Third, the common grounding frame 50 is formed on the outer wall thereof with elongated recesses 55, into which the corresponding flanges 121 formed in the dielectric housing 10 are snapped to secure the common grounding frame 50 in position. Fourth, the Schuko contacts 513 are further bent over as described above. As shown in FIG. 5A, the Schuko contacts 513 are each further bent downwardly to form a spike-like structure 5131, which is adapted for insertion into the shoulder portions 117 to fasten the Schuko contacts 513 onto the shoulder portions 117. Alternatively, the Schuko contacts 513 are each folded reversely to form a hairpin-like structure 5132 as shown in FIGS. 5B-5D, which may provide a spring effect to help counter the downward force. In the embodiment shown in FIG. 5D, the hairpin-like structure 5132 having a free end extending upwardly, onto which a spiral spring 5133 may be sleeved to increase the counter force.

Figure 6A:
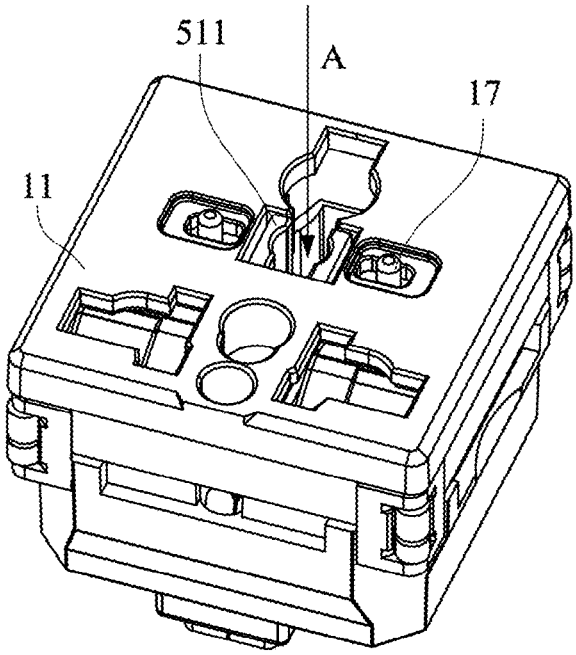
FIG. 6A is a schematic perspective view of the power connector according to the second embodiment of the invention, in which the Schuko access portion is located at the retracted position.
Figure 6B:
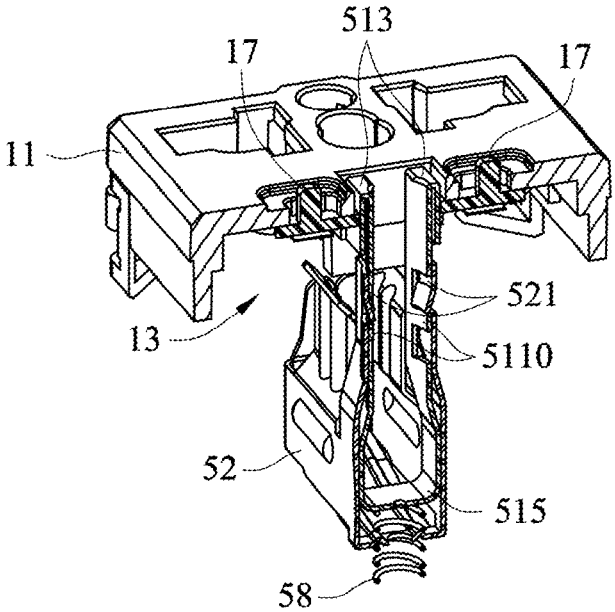
FIG. 6B is a schematic cross-sectional view of the power connector according to the second embodiment of the invention, in which the Schuko access portion is located at the retracted position.

According to the second embodiment shown in FIGS. 6A and 6B, the common grounding frame 50 is fabricated as a two-piece member, in which the Schuko access portion 511 is separately produced and then mounted to the common grounding base 52. In this case, the gripping fingers 512 are integrated with each other via a bridge part 515 and produced in one piece. The Schuko access portion 511 is sleeved at its bridge part 515 within the common grounding base 52, so that the Schuko access portion 511 is allowed to move back and forth relative to the common grounding base 52 along the insertion direction A, while being kept to be electrically connected to the common grounding base 52. The Schuko access portion 511 is biased upwardly towards the top face panel 11 by a biasing member 58. Preferably, the biasing member 58 is a slightly compressed spring extending in the insertion direction A and mounted between the Schuko access portion 511 and the common grounding base 52. However, it is apparent to those skilled in the art that other types of biasing members can also be used in the invention, so long as they are useful in biasing the Schuko access portion 511 towards the top face panel 11.

In this embodiment, the flat Schuko contacts 513 that are substantially parallel to the top face panel 11 are further bent over and extend downwardly through the Schuko grounding receptacle 113, so that the free ends thereof are kept in the interior cavity 13 at all times. As shown in FIG. 6B, the common grounding base 52 is formed with a pair of protrusions 521 and the Schuko access portion 511 is formed at its middle with a pair of projections 5110 adapted for releasably engaging the protrusions 521. When the projections 5110 are urged to engage the respective protrusions 521 by the biasing member 58, the Schuko access portion 511 is biased to reside at its retracted position as shown in FIGS. 6A and 6B, where the Schuko access portion 511 is entirely retracted into the interior cavity 13, so that the Schuko contacts 513 are located below the top face panel 11, for example, about 0.5 mm below the outer surface of the top face panel 11, and are unable to engage the flat grounding contact of a Schuko plug, thus protecting the Schuko contacts 513 from unwanted engagement and external damage. More preferably, the protrusions 521 are each configured in the form of a downwardly extending flap cut from the common grounding base 52 and bent inwardly to create a notch 525, against which the respective projections 5110 abut to keep the Schuko access portion 511 at the retracted position.

Figure 7A:
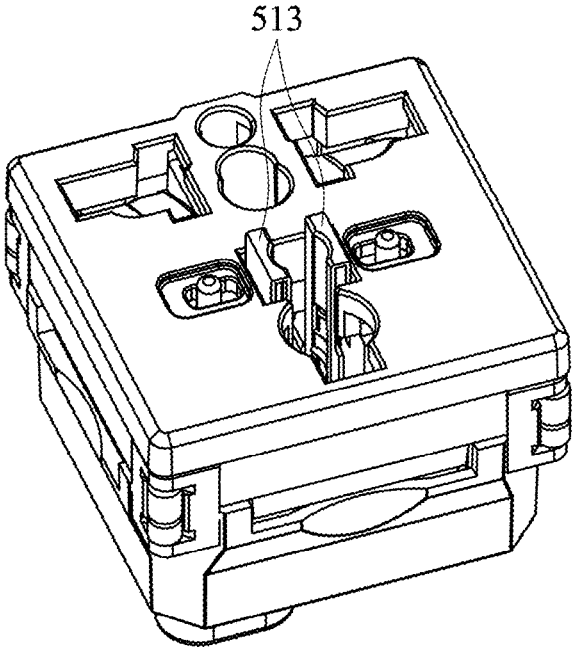
FIG. 7A is a schematic perspective view of the power connector according to the second embodiment of the invention, in which the Schuko access portion is located at the advancing position.
Figure 7B:
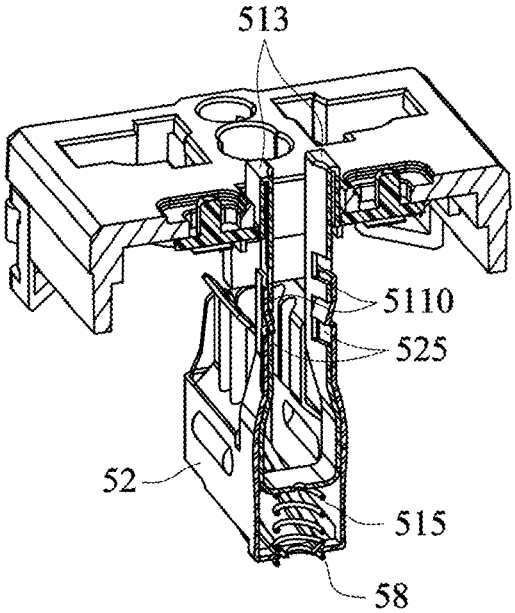
FIG. 7B is a schematic cross-sectional view of the power connector according to the second embodiment of the invention, in which the Schuko access portion is located at the advancing position.
Figure 8:
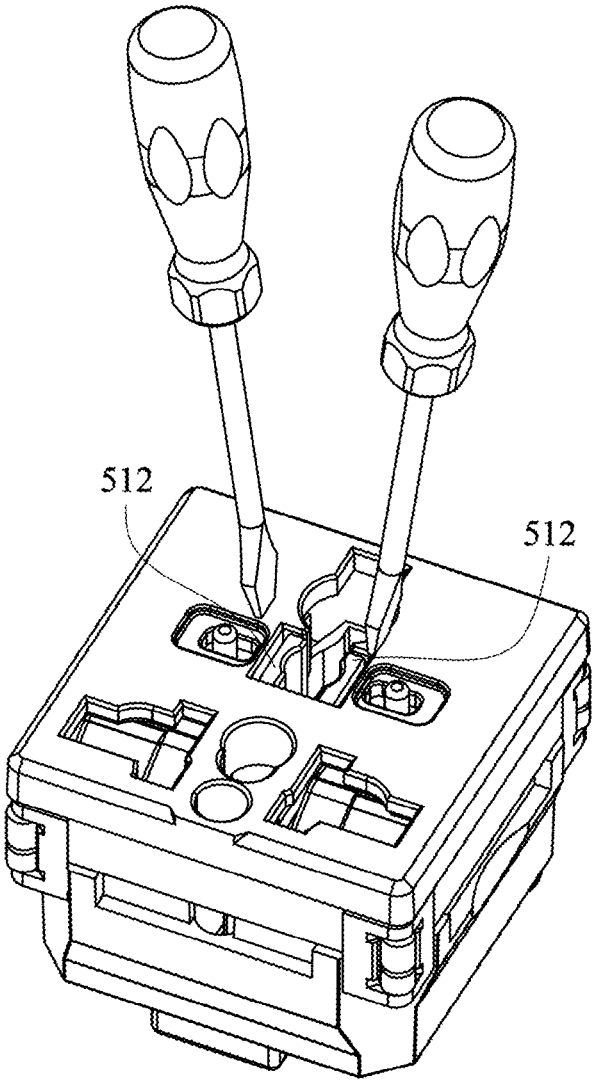
FIG. 8 is a schematic perspective view of the power connector according to the second embodiment of the invention, showing that the resilient gripping fingers are pressed using two flathead screwdrivers.

The projections 5110 can be disengaged from the protrusions 521 by pressing the resilient gripping fingers 512 towards one another, whereby the Schuko access portion 511 is pushed by the biasing member to move upwardly along the insertion direction A to its advancing position shown in FIGS. 7A and 7B. The pressing of the resilient gripping fingers 512 can be done by using hand tools, such as by using two flathead screwdrivers as shown in FIG. 8. Alternatively and preferably, the top face panel 11 is slidably provided with a pair of oppositely oriented bolts 17 adapted to abut against the gripping fingers 512, so that the gripping fingers 512 can be pressed towards one another by simply pushing the bolts 17 towards one another. When the Schuko access portion 511 is at the advancing position, the Schuko contacts 513 are positioned in a manner slightly protruding beyond the top face panel 11, such as 1-15 mm higher than the outer surface of the top face panel 11, in a bid to be ready for engagement with the flat grounding contact of a Schuko plug. The resilience force exerted by the biasing member 58 will provide a cushioning effect in the insertion direction A, so that the Schuko access portion 511 will not easily get permanently pushed down into the interior cavity 13 or get deformed irreversibly after repeatedly receiving US, Denmark and Israeli plugs.

Figure 9:
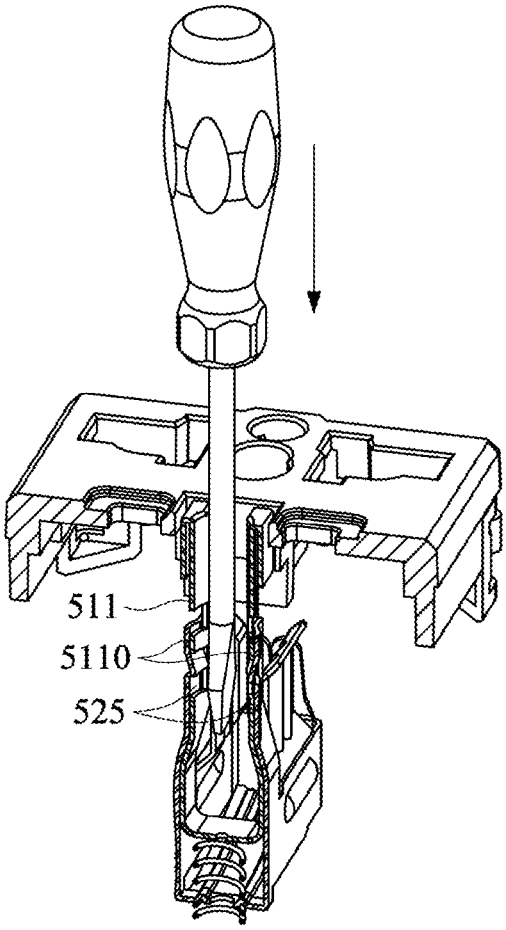
FIG. 9 is a schematic perspective view of the power connector according to the second embodiment of the invention, showing that Schuko access portion is moved back to the retracted position from the advancing position upon receiving a downward force applied by a screwdriver.

The Schuko access portion 511 may be moved back to the retracted position from the advancing position upon receiving a downward force applied by an elongated hand tool, such as a screwdriver, as shown in FIG. 9. The protrusions 521, preferably in the form of downwardly extending flaps, allow the projections 5110 to be pushed downwardly onto the protrusions 521. Once pushed on, the notch 525 engages with the projections 5110 to locate the Schuko access portion 511 at the retracted position.

The input portions 212, 222 and the common grounding base 52 are coupled to a variety of conductive couplers for electrical connection to an external power source, and the power connector disclosed herein can serve as a common architecture applicable to various forms of adapters and socket-outlets accordingly.

Figure 10A:
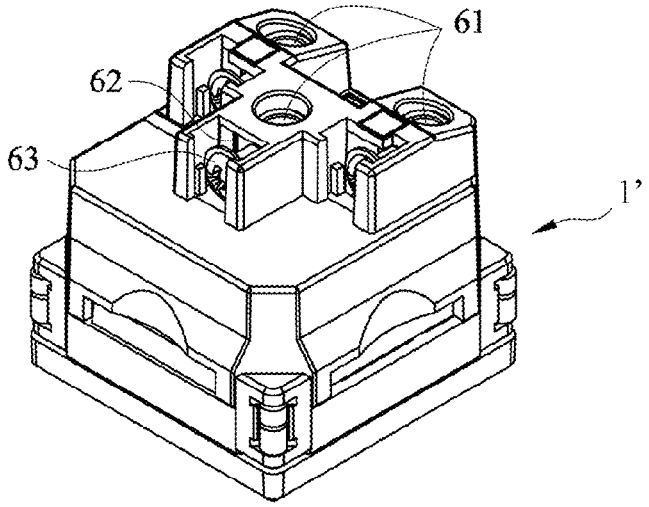
FIG. 10A is a schematic view of the power connector according to one embodiment of the invention, which is in the form of a universal socket.
Figure 10B:
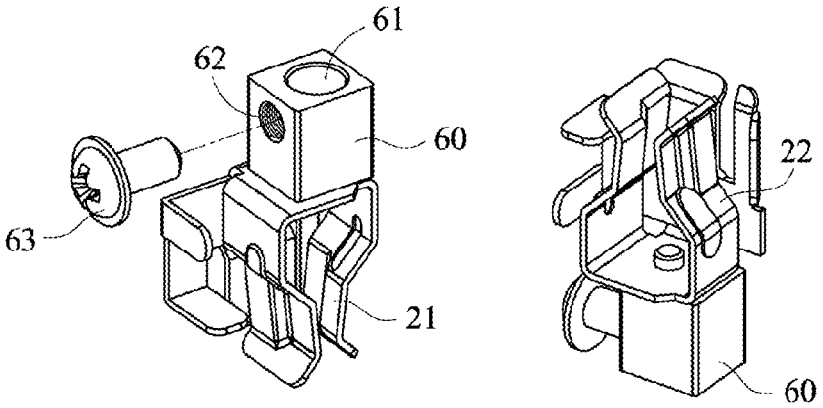
FIG. 10B is a schematic diagram showing the wire holder of the universal socket according to one embodiment of the invention.

In one embodiment, the power connector disclosed herein is fabricated as a universal socket 1' shown in FIGS. 10A and 10B, and the conductive couplers thereof are each configured in the form of a wire holder 60. The wire holder 60 is preferably a hollow metal tube formed at its open end with a blind wire bore 61 for receiving an electrical wire and further formed with a radially extending threaded hole 62 for receipt of a tightening screw 63 to hold down the electrical wire inserted into the wire bore 61. It is well-known by those skilled in the art that there are many other types of wire holders that can be used herein, such as a wire clamp adapted to hold an electrical wire.

Figure 11A:
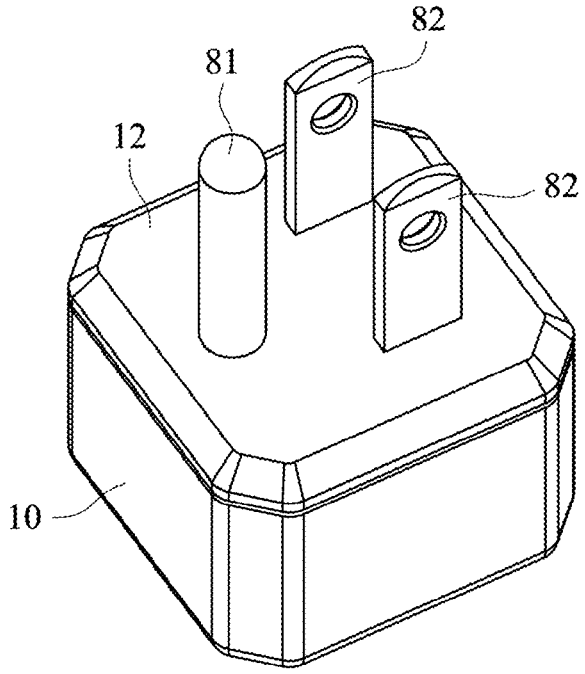
FIG. 11A is a schematic view of the power connector according to another embodiment of the invention, which is in the form of a universal adapter.
Figure 11B:
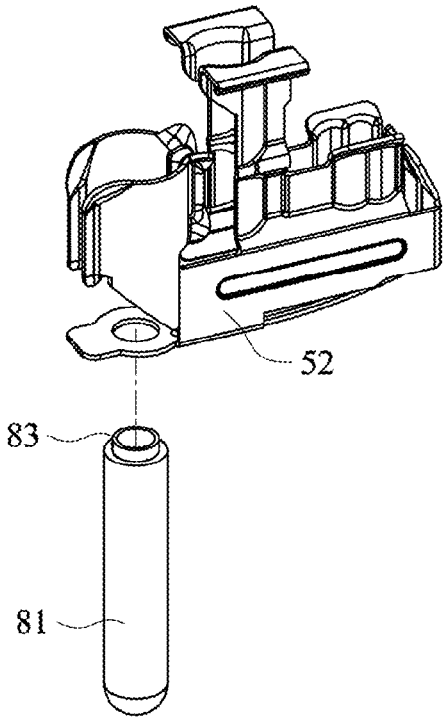
FIG. 11B is a schematic diagram showing the direct wiring connection between the common grounding frame and the ground pin.
Figure 11C:
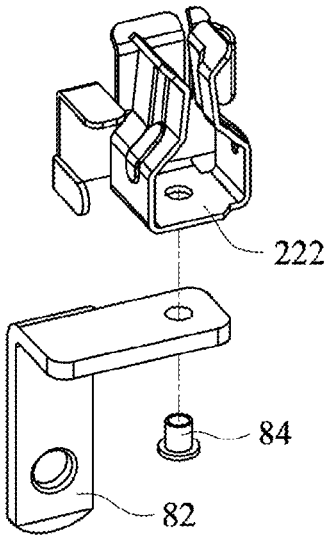
FIG. 11C is a schematic diagram showing the direct wiring connection between the power output frame and the power pin.

In another embodiment, the power connector disclosed herein is fabricated as a universal adapter 1" which comprises a plug part adapted for plugging into a domestic mains socket, in addition to the top face panel 11 at an opposite side adapted for receiving any of a variety of electric plugs. As shown in FIG. 11A, the universal adapter 1" comprises a number of conductive couplers configured in the form of plug contacts 81, 82 conforming to the domestic standards. According to the embodiment disclosed herein, the ground pin 81 is coupled to the common grounding base 52 by a rivet 83 integrally formed on the ground contact 81 as shown in FIG. 11B, whereas the live and neutral pins 82 are similarly fastened to the input portions 212, 222 with a rivet 84 as shown in FIG. 11C.

Preferably, the power connector 1 disclosed herein is further provided with a safety shutter assembly 3 mounted within the housing, as shown in FIG. 1A. The safety shutter assembly 3 is arranged to be slidable in a direction generally perpendicular to the insertion direction A, as a means to open or close the power receptacles 111, 112. In a more preferred embodiment, the safety shutter assembly 3 is so arranged that it is driven to move towards the Schuko contact 513 in response to the insertion of an electric plug. It was unexpectedly found by the inventors that such arrangement facilitates the attachment of the flat grounding contact of a Schuko plug onto the Schuko contact 513 by urging the safety shutter assembly 3 to push the plug towards the Schuko contact 513.

While the invention has been described with reference to the preferred embodiments above, it should be recognized that the embodiments are given for the purpose of illustration only and are not intended to limit the scope of the invention and that various modifications and changes, which will be apparent to those skilled in the art, may be made without departing from the spirit and scope of the invention.

What is claimed is:

1. A power connector for engagement with a Schuko plug having two male power contacts and a flat grounding contact, comprising:

a dielectric housing, comprising a top face panel, wherein the top face panel is formed with two power receptacles, through which the male power contacts may be inserted, and a grounding receptacle;

two electrically conductive power output frames mounted spaced apart in the housing, each having an output contact portion facing towards the top face panel and adapted for receiving the respective male contact of the electric plug through the respective power receptacle along an insertion direction, and an input portion remote from the top face panel; and an electrically conductive common grounding frame, comprising a common grounding base remote from the top face panel, and a Schuko access portion connected to the common grounding base, the Schuko access portion facing towards the top face panel and having two resilient gripping fingers, wherein the resilient gripping fingers extend upwardly beyond the top face panel through the grounding receptacle and bent outwardly in opposite directions to constitute flat Schuko contacts adapted to engage the flat grounding contact of the Schuko plug.

2. The power connector according to claim 1, wherein the Schuko contacts are further bent over to provide additional structural strength.

3. The power connector according to claim 2, wherein the common grounding frame is fabricated as a single-piece member and arranged to extend along a substantially full depth of the dielectric housing, and wherein the top face panel is formed with shoulder portions surrounding the Schuko grounding receptacle, on which the Schuko contacts are anchored.

4. The power connector according to claim 3, wherein the Schuko contacts are each bent downwardly to form a spike-like structure, which is inserted into the shoulder portions to fasten the Schuko contacts onto the shoulder portions.

5. The power connector according to claim 3, wherein the Schuko contacts are each folded reversely to form a hairpin-like structure.

6. The power connector according to claim 5, wherein the hairpin-like structure has a free end extending upwardly, onto which a spiral spring is sleeved.

7. The power connector according to claim 2, wherein the common grounding frame is fabricated as a two-piece member, and wherein the Schuko access portion is sleeved within the common grounding base, so that the Schuko access portion is allowed to move back and forth relative to the common grounding base along the insertion direction.

8. The power connector according to claim 7, wherein the Schuko access portion is biased upwardly by a biasing member mounted between the Schuko access portion and the common grounding base.

9. The power connector according to claim 8, wherein the biasing member is a compressed spring extending in the insertion direction.

10. The power connector according to claim 9, wherein the common grounding base is formed with a pair of protrusions and the Schuko access portion is formed with a pair of projections adapted for releasably engaging the protrusions, and wherein the Schuko access portion is retracted to locate the Schuko contacts below the top face panel, when the projections are urged to engage the respective protrusions.

11. The power connector according to claim 10, wherein the protrusions are each configured in the form of a downwardly extending flap cut from the common grounding base and bent inwardly to create a notch adapted for engaging the respective projections.

12. The power connector according to claim 11, wherein the input portions and the common grounding base are each directly riveted with a conductive coupler for electrical connection to an external power source.

13. The power connector according to claim 12, wherein the conductive coupler is configured in the form of a wire holder for receiving an electrical wire.

14. The power connector according to claim 12, wherein the conductive coupler is configured in the form of a plug contact for insertion into an electric socket.

15. The power connector according to claim 1, further comprising a safety shutter assembly mounted within the dielectric housing and arranged to be slidable in a direction generally perpendicular to the insertion direction as a means to open or close the power receptacles, and wherein the safety shutter assembly is so arranged that it is driven to move towards the Schuko contact in response to insertion of the Schuko plug.

* * * * *